US008816877B2

(12) United States Patent
Gielblat et al.

(10) Patent No.: US 8,816,877 B2
(45) Date of Patent: Aug. 26, 2014

(54) ROAD GANTRY

(75) Inventors: Jacques Gielblat, Boissise le Roi (FR); Lionel Reinold, Venette (FR)

(73) Assignee: SANEF, Paris (FR)

( * ) Notice: Subject to any disclaimer, the term of this patent is extended or adjusted under 35 U.S.C. 154(b) by 283 days.

(21) Appl. No.: 13/257,685

(22) PCT Filed: Mar. 17, 2010

(86) PCT No.: PCT/FR2010/000224
§ 371 (c)(1),
(2), (4) Date: Jan. 4, 2012

(87) PCT Pub. No.: WO2010/106247
PCT Pub. Date: Sep. 23, 2010

(65) Prior Publication Data

US 2012/0092188 A1 Apr. 19, 2012

(30) Foreign Application Priority Data

Mar. 20, 2009 (FR) ..... 09 01307

(51) Int. Cl.
*G08G 1/00* (2006.01)
*E01F 9/011* (2006.01)

(52) U.S. Cl.
CPC ..... *E01F 9/0113* (2013.01)
USPC ..... 340/928; 340/927; 340/930; 340/932.1

(58) Field of Classification Search
USPC ..... 340/928, 908, 927, 930, 932.1; 248/544
See application file for complete search history.

(56) References Cited

U.S. PATENT DOCUMENTS

| | | | | |
|---|---|---|---|---|
| 5,554,984 | A * | 9/1996 | Shigenaga et al. | 340/937 |
| 6,191,705 | B1 * | 2/2001 | Oomen et al. | 340/905 |
| 7,388,501 | B2 * | 6/2008 | Tang et al. | 340/572.7 |
| 7,813,699 | B2 * | 10/2010 | Ho et al. | 455/41.2 |

FOREIGN PATENT DOCUMENTS

| | | | |
|---|---|---|---|
| DE | 202 04 634 | U1 | 8/2002 |
| DE | 102 44 352 | A1 | 4/2004 |
| EP | 0 995 840 | A2 | 4/2000 |
| EP | 1502999 | A1 | 2/2005 |
| WO | WO 2008/056017 | A1 | 5/2008 |

OTHER PUBLICATIONS

International Search Report and Written Opinion for International Application No. PCT/FR2010/000224, mailed Jul. 5, 2010.

* cited by examiner

*Primary Examiner* — Toan N Pham
(74) *Attorney, Agent, or Firm* — Alston & Bird LLP

(57) ABSTRACT

The invention relates to a road gantry comprising a horizontal beam (2), the upper surface (21) of which constitutes a passageway for service personnel to cross, the gantry being characterized in that it comprises arms (25) for bearing apparatuses (30) for monitoring road traffic, electronic toll collection, or signaling, wherein said arms are pivotably attached to the horizontal beam so as to be able to move from a first position, in which the arms extend towards the road, into a second position for stowage on said passageway, and vice versa. The passageway may comprise protection guardrails (22, 23) in which openings (24) are formed, said openings being shut by door panels (24) arranged so as to enable the passage of said arms (25) from said first position to said second position and vice versa. The invention also relates to a barrier-free electronic toll collection station including at least one such gantry.

10 Claims, 2 Drawing Sheets

ROAD GANTRY

The invention relates to a road gantry adapted to carry devices for traffic surveillance, electronic toll collection, or signaling. The gantry of the invention is particularly adapted to making free-flow (barrier-free) electronic toll collection stations.

Document EP 0 995 840 describes a road gantry made up of two vertical pillars carrying a horizontal beam, suitable for having signaling panels fastened thereto, which panels slide on rails. The panels may be raised or lowered to or from said horizontal beam by means of a hoist.

Document EP 1 502 999 also describes a road gantry carrying signaling panels. In that gantry, the horizontal beam contains an internal gangway on two superposed levels, along which maintenance personnel can pass. A side surface of the beam is formed by signaling panels constituted by pivotally-mounted strips; maintenance personnel can act from the gangway to cause those strips to pivot in order to modify the signal displayed by the panel.

Document DE 102 44 352 describes a road gangway likewise constituted by two vertical pillars and a horizontal beam, and adapted to carry electronic toll collection devices. Those devices are fastened to the pillars and to the beam by supports that can be swiveled, moved, and removed.

In all those situations, it is relatively complex to install, replace, or maintain the signaling panels or the devices carried by the gantry. That problem is made even worse by the very strict safety requirements that are essential when such operations need to be carried out without interrupting vehicle traffic under the gantry. Under such conditions, any equipment that might be dropped, even only a screw, could have extremely severe consequences.

The invention seeks to resolve that drawback of the prior art by providing a road gantry suitable for carrying traffic surveillance, electronic toll collection or signaling devices that are capable of being installed, removed, replaced, verified, and/or maintained in a manner that is simple and safe.

In accordance with the invention, this object is achieved by a road gantry comprising a horizontal beam suitable for extending transversely over a road, said beam having a top surface constituting a gangway along which maintenance personnel can pass; the gantry being characterized in that it also includes at least one arm adapted to carry a traffic surveillance, electronic toll collection, or signaling device, said or each arm being pivotally fastened to said horizontal beam so as to be capable of passing from a first position in which it extends towards the road, to a second position in which it is retracted onto said gangway, and vice versa.

Advantageously, such a gantry may also include railings for protecting said gangway, at least one opening being provided in said railings to enable said arm(s) to pass from said first position to said second position, and vice versa. Preferably, the gantry may also include one or more opening panels for closing said opening(s) formed in said railings.

It is appropriate for said gangway and said railings to be adapted to prevent any items falling accidentally onto said road.

In particular embodiments of the invention:

The or each arm may include a lug suitable for co-operating with a separate lever arm to enable the arm to be pivoted from said first position to said second position.

In a variant, said or each arm may include an actuator to enable it to be pivoted automatically from said first position to said second position, and vice versa.

Said or each arm may include a swivel platform arranged at its distal end to enable a traffic surveillance, electronic toll collection, or signaling device to be fastened thereto.

The gantry may include a plurality of said arms fastened to at least one side of said horizontal beam.

More particularly, said arms may carry devices for detecting and/or identifying vehicles, suitable for implementing a free-flow electronic toll collection station.

The invention also provides a free-flow electronic toll collection station including at least one such gantry.

Other characteristics, details, and advantages of the invention appear on reading the following description made with reference to the accompanying drawings given by way of example and in which:

FIG. 1 shows a free-flow electronic toll collection station constituted by two gantries P1 and P2 placed along a road R, or more precisely an entry or exit slip road of a motorway or freeway.

Typically, the first gantry P1 is fitted with laser devices enabling vehicles to be detected and classified, while the second gantry is fitted with antennas for communicating with electronic toll collection transponders and also with cameras enabling the number plates of said vehicles to be read.

Each gantry is essentially constituted by two pillars 11, 12 placed on either side of the road R and supporting a horizontal beam 2 that extends over said road, transversely relative thereto.

Figure 1:
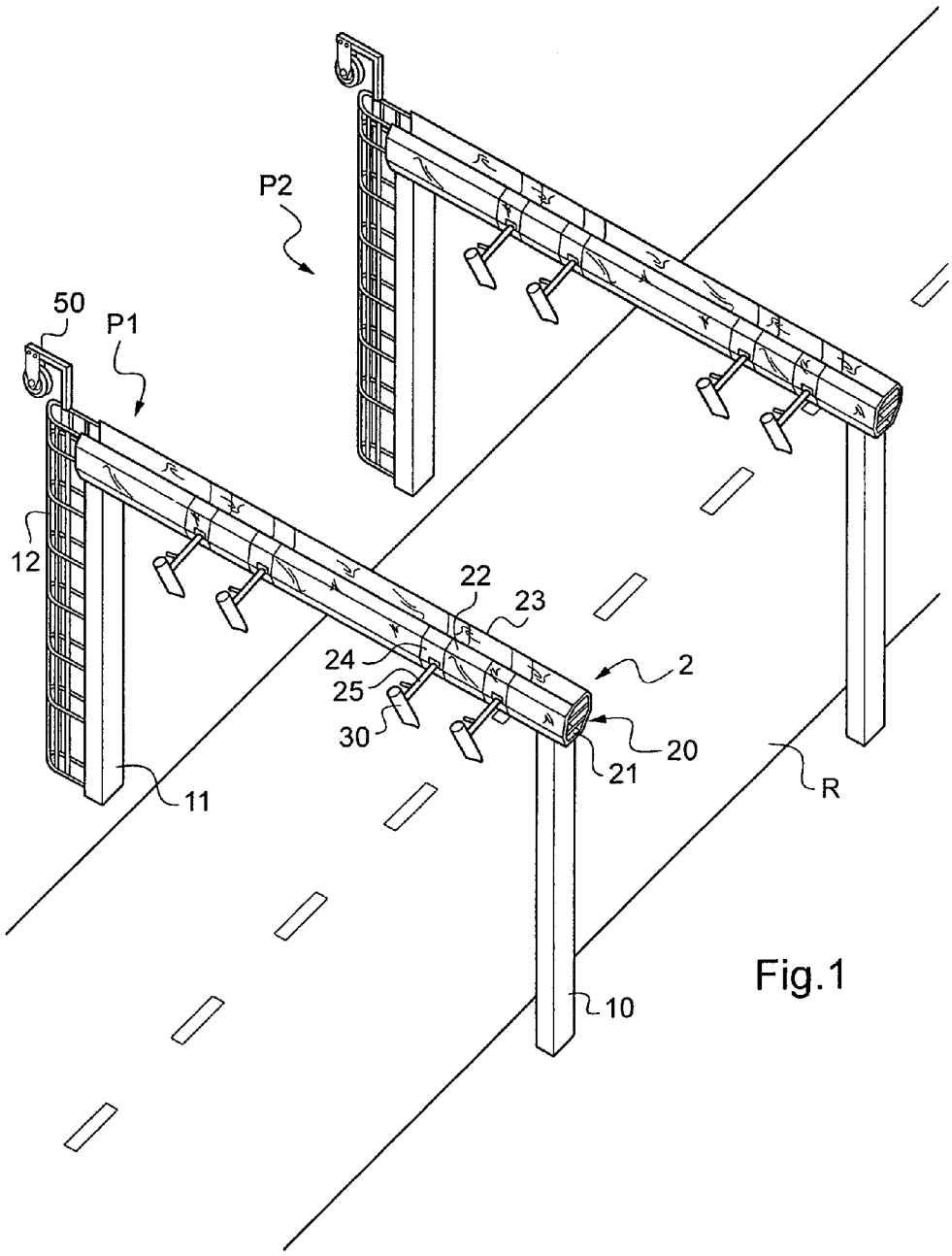
FIG. 1 shows a free-flow electronic toll collection station comprising two gantries of the invention.
Figure 2:
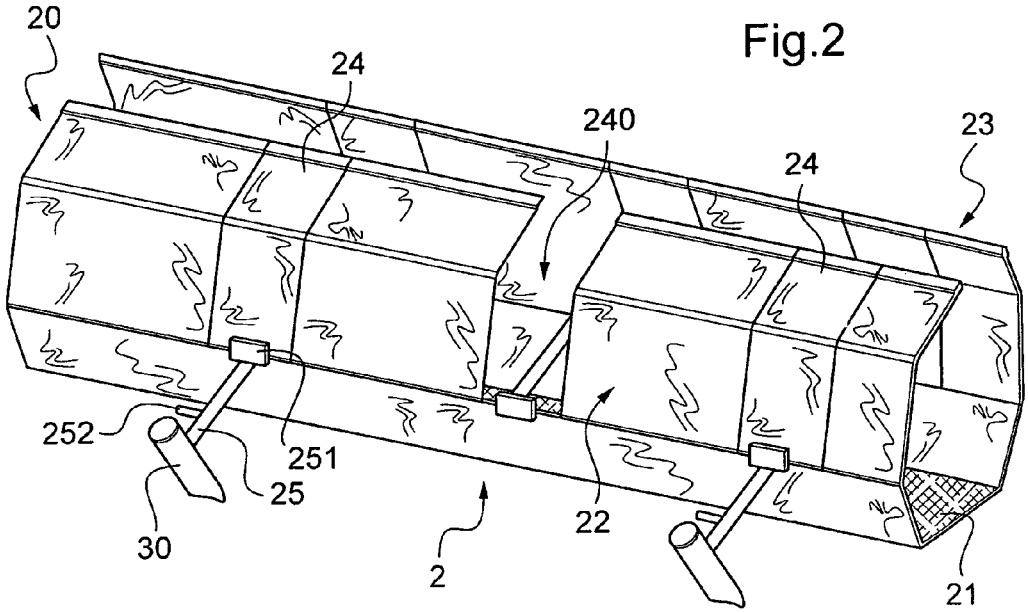
FIG. 2 is a detail view of the horizontal beam of such a gantry.

As shown in FIGS. 1 and 2, the beam 2 has a bottom surface 21 that is wide enough and strong enough to support the weight of one or more maintenance personnel, thereby constituting a gangway, which gangway is made safe by railings 22 and 23. A ladder 12 fitted with appropriate protection is fastened to one of the pillars (11) in order to give access to the gangway.

In the figures, reference 20 encompasses both the top surface 21 of the beam 2 and the railings 22 and 23.

The gangway 21 and the railings 22 and 23 should preferably constitute effective protection against items, even small items, being dropped accidentally onto the road R. For example, these elements may be constituted by solid panels or by netting having a mesh that is sufficiently fine. Netting is preferable, in particular for the railings, in order to minimize wind resistance.

Arms 25 are fastened to the horizontal beam 2 in order to act via swivel platforms 253 arranged at their distal ends in order to carry devices 30 that may be electronic toll collection, surveillance, and/or signaling devices, as mentioned above.

Several devices of different types may be fitted to the same gantry. The arms 25 may be provided on one side only of the gantries P1 and P2, as shown in the figures, or advantageously on both sides.

Figure 3:
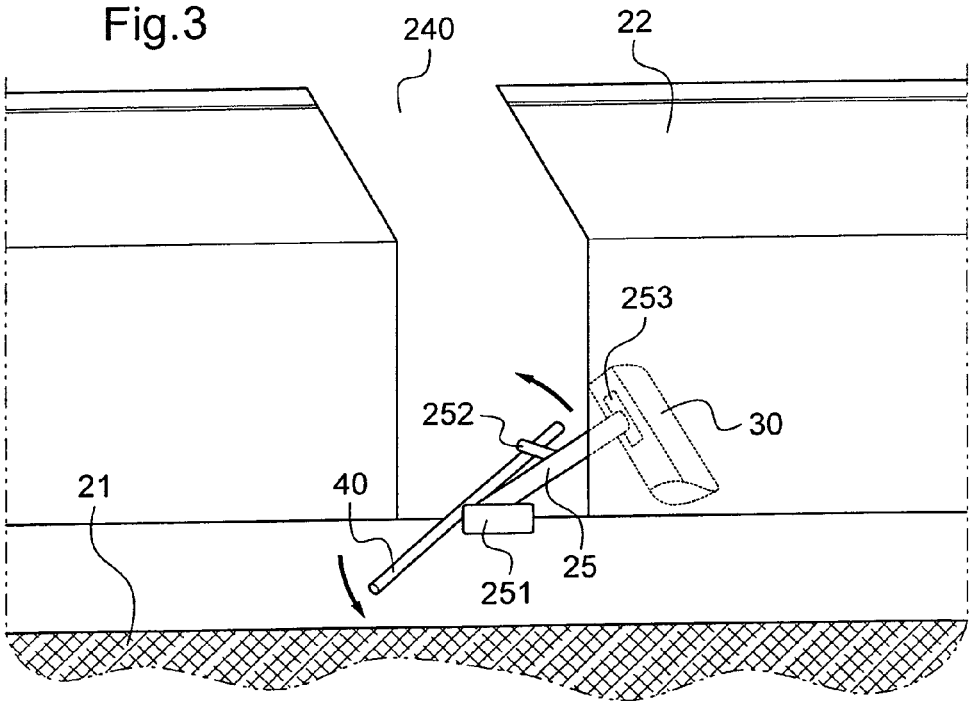
FIG. 3 is another detail view of said horizontal beam, from inside the gangway.

In the embodiment of FIGS. 2 and 3, the arms 25 are fastened to a bottom portion of a side surface of the beam 2, beneath the railings. Fastening may be via a pivot connection 251 presenting a horizontal axis parallel to the beam 2. Thus, the arms 25 may pivot about said axis from a first position in which they extend laterally and downwards towards the road, to a second position in which they are retracted onto the gangway 21, and vice versa.

In order to enable the arms 25 to retract onto the gangway 21, vertical openings 240 are provided in the railings in correspondence with said arms. In normal operating conditions of the electronic toll collection station, these openings are closed by panels 24; where necessary, the panels may be removed in order to free the corresponding openings 240 and enable the arms to be retracted. For safety reasons, it is preferable to fasten the panels 24 to the gangway by straps in order to avoid a panel being dropped accidentally onto the roadway. In a variant, it is possible to use panels that slide or pivot like shutters, thereby enabling the openings 240 to be freed without separating the panels from the beam 2.

FIG. 2 shows a portion of beam 2 carrying three arms 25, two of which are projecting from said beam towards the road and one of which is retracted onto the gangway 21 through the corresponding opening 240.

By means of the invention, it is extremely simple to take action on a device 30 for the purposes of maintenance, inspection, or replacement. A maintenance operative climbs onto the gangway 21 via the ladder 12 and walks to the location of the arm carrying the device 30 in question. Thereafter, the panel 24 is opened to free the opening 240 and allow the operative to pivot the arm 25 inwards so as to bring it onto the gangway 21. To do this, it is possible to use a separate lever arm 40 (a simple metal rod suffices) that co-operates with a lug 252 provided for this purpose and projecting laterally from the arm 25, as shown in FIG. 3. In a variant, the arm 25 may be motor-driven. Once the arm has been retracted, the maintenance operative recloses the panel 24: although this operation is theoretically optional, it is recommended for safety reasons.

In this way, disassembly/assembly or maintenance may be carried out on the device 30 while the operative is completely inside the gangway that is closed on its side 20, thereby avoiding any risk of items (tools, fasteners, pieces of the device 30, etc.) being dropped onto the road. In addition, the maintenance operative can work on the device 30 in relative comfort, and thus quickly and effectively.

Once the required action has been completed, the maintenance operative re-opens the panel 24, causes the arm 25 to pivot from its second position to its first position, and then closes the shutter 24 for the last time.

A hoist 50 is provided on one of the pillars 11 of the gangway in order to enable devices 30 that are to be installed to be raised or to enable previously-dismantled devices to be lowered.

The invention claimed is:

1. A road gantry comprising a horizontal beam suitable for extending transversely over a road, said beam having a top surface constituting a gangway along which maintenance personnel can pass; the gantry comprising at least one arm adapted to carry a traffic surveillance, electronic toll collection, or signaling device, said at least one arm being pivotally fastened to said horizontal beam so as to be capable of passing from a first position in which it extends towards the road, to a second position in which it is retracted onto said gangway, and vice versa.

2. A gantry according to claim 1, also including railings for protecting said gangway, at least one opening being provided in said railings to enable said arm(s) to pass from said first position to said second position, and vice versa.

3. A gantry according to claim 2, also including one or more opening panels for closing said opening(s) formed in said railings.

4. A gantry according to claim 2, wherein said gangway and said railings are adapted to prevent any items falling accidentally onto said road.

5. A gantry according to claim 1, wherein the said at least one arm includes a lug suitable for co-operating with a separate lever arm to enable the arm to be pivoted from said first position to said second position.

6. A gantry according to claim 1, wherein said at least one arm includes an actuator to enable it to be pivoted automatically from said first position to said second position, and vice versa.

7. A gantry according to claim 1, wherein said at least one arm includes a swivel platform arranged at its distal end to enable a traffic surveillance, electronic toll collection, or signaling device to be fastened thereto.

8. A gantry according to claim 1, including a plurality of said arms fastened to at least one side of said horizontal beam.

9. A gantry according to claim 8, wherein said arms carry devices for detecting and/or identifying vehicles, suitable for implementing a free-flow electronic toll collection station.

10. A free-flow electronic toll collection station including at least one gantry according to claim 9.

* * * * *